US005485702A

United States Patent [19]

Sholton

[11] Patent Number: 5,485,702

[45] Date of Patent: Jan. 23, 1996

[54] MORTARLESS GLASS BLOCK ASSEMBLY

[75] Inventor: Bernard C. Sholton, Coral Gables, Fla.

[73] Assignee: Glenn Sholton, Coral Gables, Fla.

[21] Appl. No.: 217,925

[22] Filed: Mar. 25, 1994

[51] Int. Cl.[6] ..... E04C 1/42

[52] U.S. Cl. ..... 52/308; 52/307; 52/396.09; 52/747.1; D25/103; D25/121

[58] Field of Search ..... 52/306, 307, 308, 52/396.08, 396.09, 747; D25/103, 121, 123, 138

[56] References Cited

U.S. PATENT DOCUMENTS

| | | | |
|---|---|---|---|
| D. 323,896 | 2/1992 | Alcazar | D25/103 |
| D. 325,640 | 4/1992 | Ballstadt | D25/103 X |
| 1,686,161 | 10/1928 | Liese | 52/307 |
| 2,141,000 | 12/1938 | Hohl | 52/308 |
| 2,162,987 | 6/1939 | Winship | 52/308 |
| 2,176,213 | 10/1939 | Duffy | 52/396.09 X |
| 2,182,373 | 12/1939 | Cox | 52/396.08 X |
| 2,216,220 | 10/1940 | Baker | 240/1 |
| 2,239,537 | 4/1941 | Owen | 52/308 |
| 2,318,362 | 5/1943 | Boeglen et al. | 52/308 |
| 2,324,038 | 7/1943 | Steele | 20/60 |
| 2,346,170 | 4/1944 | Kalkusch | 72/17 |
| 2,708,359 | 5/1955 | Henry | 52/396.08 |
| 2,835,623 | 5/1958 | Vincent et al. | 52/308 |
| 3,234,699 | 2/1966 | Smith | 52/308 |
| 4,058,943 | 11/1977 | Sturgill | 52/227 |
| 4,774,793 | 10/1988 | Mayer | 52/308 |
| 4,959,937 | 10/1990 | Mayer | 52/308 |
| 4,965,975 | 10/1990 | Schwarz | 52/308 |
| 4,986,048 | 1/1991 | McMarlin | 52/306 |
| 5,003,744 | 4/1991 | Taylor | 52/308 |
| 5,009,048 | 4/1991 | Paul | 52/308 |
| 5,010,704 | 4/1991 | Thompson | 52/308 |
| 5,031,372 | 7/1991 | McCluer | 52/307 |
| 5,146,725 | 9/1992 | Bruce et al. | 52/308 |
| 5,259,161 | 11/1993 | Carter | 52/307 |
| 5,430,985 | 7/1995 | Coleman | 52/308 |

OTHER PUBLICATIONS

STECKFIX® Glasstein System Brochure, exact date and place of publication unknown.

KWIK'N EZ™ Silicon System Installation Brochure, 1990; Pittsburgh Corning Corporation.

Article entitled: "Installing Glass Block With Silicon", Oct., 1991, vol. 4, No. 10 issue of Aberdeen's Magazine of Masonry™ Construction, Aberdeen Group.

*Primary Examiner*—Carl D. Friedman
*Assistant Examiner*—Laura A. Saladino
*Attorney, Agent, or Firm*—Kirkpatrick & Lockhart

[57] ABSTRACT

A spacer used with substantially rectangularly-shaped glass blocks of the type having a ridge positioned intermediate its top, bottom, and side edges. The spacer comprises first and second oppositely positioned channel portions adapted to receive the seams of adjacent glass blocks. The channel portions define first and second ends. First and second oppositely positioned curved portions extend from the first end of the channel portions and a first pad extends from a junction between the first and second oppositely positioned curved portions. Third and fourth oppositely positioned curved portions extend from the second end of the channel portions and a second pad extends from a junction between the third and fourth oppositely positioned curved portions. The first, second, third, and fourth curved portions are each configured to form a friction fit with adjacent glass blocks while the lips of the adjacent blocks contact the first and second pads.

13 Claims, 3 Drawing Sheets

MORTARLESS GLASS BLOCK ASSEMBLY

BACKGROUND OF THE INVENTION

1. Field of the Invention

The present invention is directed generally to the art of building construction and more specifically to panels constructed of glass blocks.

2. Description of the Invention Background

Glass blocks have been widely used for decades in the construction industry as partitions, exterior walls, and windows in buildings of all kinds. Glass blocks are typically formed by fusing together two pieces of glass. The seam where the two pieces of glass are fused together is centrally located along the top, bottom, and two side edges of the glass block. The seam is characterized by an upwardly extending ridge which gives the edges of glass blocks their unique profile.

Glass blocks are assembled in panels using a variety of assembly techniques. However, those techniques can be broadly categorized as mortar, and mortarless techniques. Techniques involving the use of mortar result in a panel of glass blocks which is assembled at the construction site or preassembled in a workshop by mortaring courses of glass blocks together much in the same way that courses of clay brick are mortared together. Unfortunately, the nonporous, nonabsorbent surfaces of the edges of glass blocks do not permit the formation of as strong a bond with the mortar as is the case with clay brick. Accordingly, those of ordinary skill in the art have sought ways to develop a stronger bond between the mortar and the glass blocks. Such efforts have led to the roughening of the edges, the application of resinous coatings to the edges, or the incorporation of special ingredients to the mortar in an effort to enable the mortar to form a stronger bond with the glass blocks.

As with the laying of bricks, the construction of glass block panels using mortar requires the talents of a skilled artisan. If the mortar is not of a uniform thickness, the glass blocks will not be properly laid and the resulting panel may be of uneven dimension. Also, the use of mortar is accompanied by dust and dirt in the construction area. Another drawback of glass block panels assembled with mortar is that the panels may not be assembled too quickly. Otherwise, the weight of the glass blocks will tend to squeeze the mortar out from between the lower courses. Thus, the construction of a mortared glass block panel is a time consuming task which requires substantial skill.

To overcome the drawbacks of mortared glass block panels, mortarless panels were developed. Mortarless panels are typically characterized by a spacer interposed between each of the glass blocks. The spacer ensures uniform spacing between the blocks. The spacer is typically of a width which is less than the width of the glass blocks such that a grid of troughs or grooves is formed when the glass blocks are assembled in a panel. The troughs or grooves are filled with some type of sealant which binds adjacent blocks together and usually keeps out humidity.

An example of the foregoing type of mortarless glass block panel is disclosed in U.S. Pat. No. 2,239,537. The spacer member disclosed in that patent is a metal plate which carries spaced resilient flanges. The resilient flanges form the trough between adjacent glass blocks which is filled with a mastic or other suitable caulking compound.

Another example of a mortarless glass block panel is disclosed in U.S. Pat. No. 4,058,943. Disclosed in that patent is a spacer member formed of wood or plastic. The width of the spacer member is dimensioned to provide a groove between adjacent glass blocks. The groove is partially filled with a filler bar, and the remainder of the groove is filled with a silicone caulking material which adheres to the spacer member to provide a chip resistant, mortar-like joint. The glass block panel may also be held together by a band tightly circumscribing the perimeter of the glass block panel.

Another example of a mortarless glass block panel is disclosed in U.S. Pat. No. 4,986,048. Disclosed in that patent is a spacer having a particular cross-section adapted to engage the edges of adjacent glass blocks at particular points. The width of the spacer is such that a groove is provided between adjacent glass blocks. The groove is filled with a translucent or colored silicone caulking which cures and sets to rigidify the glass block panel.

Although mortarless glass block panels avoid the drawbacks of traditional mortared glass block panels, mortarless glass block panels have drawbacks of their own. The spacers used in some mortarless glass block panels are unduly heavy and rigid thus adding unnecessary weight to the glass block panel. Other spacers provide only limited support. Still others are comprised of several parts which make it cumbersome to assemble the glass block panel. Accordingly, the need exists for a mortarless glass block panel which provides the desired degree of rigidity without adding undue weight to the glass block panel and which can be easily and quickly assembled by relatively unskilled workers, while giving the glass block panel much structural strength.

SUMMARY OF THE INVENTION

The present invention is directed to a spacer, a glass block panel assembled with the spacer, and a method of assembling glass block panels using the spacer. The spacer is intended to be used with substantially rectangularly-shaped glass blocks of the type having a seam positioned intermediate its top, bottom, and side edges. The spacer comprises first and second oppositely positioned channel portions adapted to receive the seams of adjacent glass blocks. The channel portions define first and second ends. First and second oppositely positioned curved portions extend from the first end of the channel portions and a first pad extends from a junction between the first and second oppositely positioned curved portions. Third and fourth oppositely positioned curved portions extend from the second end of the channel portions and a second pad extends from a junction between the third and fourth oppositely positioned curved portions. The first, second, third, and fourth curved portions are each configured to form a friction fit with adjacent glass blocks while the lips of the adjacent blocks contact the first and second pads.

A panel of glass blocks assembled using the spacer of the present invention comprises a plurality of generally rectangularly-shaped glass blocks having horizontal and vertical edges with each edge having a central ridge running therealong. The glass blocks are arranged to form a glass block panel in which horizontally adjacent blocks have abutting vertical edges and vertically adjacent blocks have abutting horizontal edges. A strap may extend around the perimeter of the glass block panel. If the panel is wider than it is tall, the required full lengths of horizontally extending spacers are interposed between the abutting horizontal edges, and if the panel is taller than it is wide, the required full lengths of vertically extending spacers are interposed between abutting vertical edges. Small pieces of the spacer are interposed between the remainder of the abutting edges to provide a uniform spacing between adjacent glass blocks. The width of the spacers is slightly less than the width of the glass blocks such that a groove is formed between adjacent glass blocks. A sealant is positioned in the groove.

A method of assembling a panel of rectangularly-shaped glass blocks having horizontal top and bottom edges and vertical side edges with each edge having a central seam running therealong using the spacer of the present invention comprises the steps of:

(a) assembling a sill channel and a jamb channel;

(b) placing a strap of sufficient length to extend around the perimeter of the assembled glass block panel in the sill and jamb channels;

(c) positioning a first glass block in the area where the sill and jamb channels meet;

(d) positioning a spacer member, with silicone applied to the four oppositely positioned curved portions and/or its central channel, if desired, for additional structural strength, on the top edge of the first glass block, the spacer member having a length slightly less than the first glass block so as to allow room for the camber of the spacer interposed between the abutting edges of the glass blocks as described in (g) below;

(e) positioning a second glass block on top of the spacer member and adjacent the first glass block, the spacer member having a first face contacting the first glass block and a second face contacting the second glass block, the first and second faces configured to form a friction fit with the adjacent glass blocks and sized to form a groove between the adjacent glass blocks;

(f) repeating steps (d) and (e) until a vertical course of glass blocks is completed;

(g) positioning a spacer member, with silicone applied to the four oppositely positioned curved portions and/or its central channel, if desired, for additional structural strength, adjacent an exposed edge of the vertical course, the spacer member being of the type previously described and of a length substantially equal to the height of the vertical course;

(h) assembling additional vertical courses as previously described, except that the lengths of the spacers positioned between the glass blocks in the courses other than the last course is slightly less than the length described in (d) above so as to allow room also for the camber of the spacer interposed between the abutting edges on the other side of these glass blocks, until a panel of the desired dimensions is assembled;

(i) affixing the strap around the perimeter of the assembled glass block panel; and (j) applying a sealant in the grooves formed by adjacent glass blocks and the spacer members. The foregoing method can also be applied to assemble a panel using horizontal instead of vertical courses of glass blocks.

Because the spacer of the present invention automatically provides uniform spacing between adjacent glass blocks, panels of glass blocks can be assembled by less skilled workers. Additionally, because the spacer does not need time to set or cure, the panel can be assembled as quickly as the worker can lay courses of blocks. The panel is rigid by virtue of the rigid PVC spacer and its weight is minimized. Those, and other advantages and benefits of the present invention, will become apparent from the Description of a Preferred Embodiment hereinbelow.

BRIEF DESCRIPTION OF THE DRAWINGS

For the present invention to be clearly understood and readily practiced, it will now be described in conjunction with the following figures wherein.

DESCRIPTION OF THE PREFERRED EMBODIMENT

Figure 1:
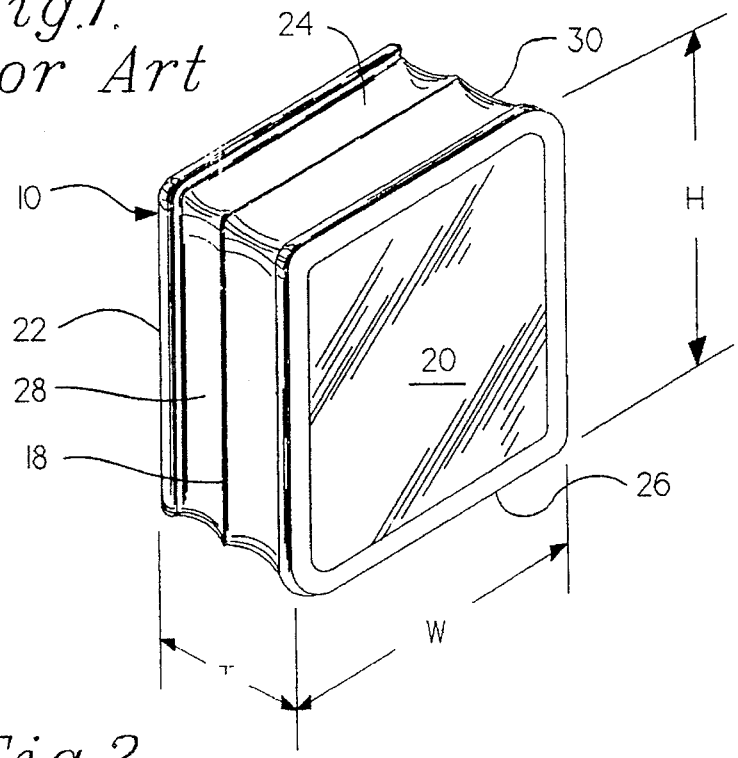
Fig.1. Prior Art
FIG. 1 is a perspective view of a typical glass block.
Figure 2:
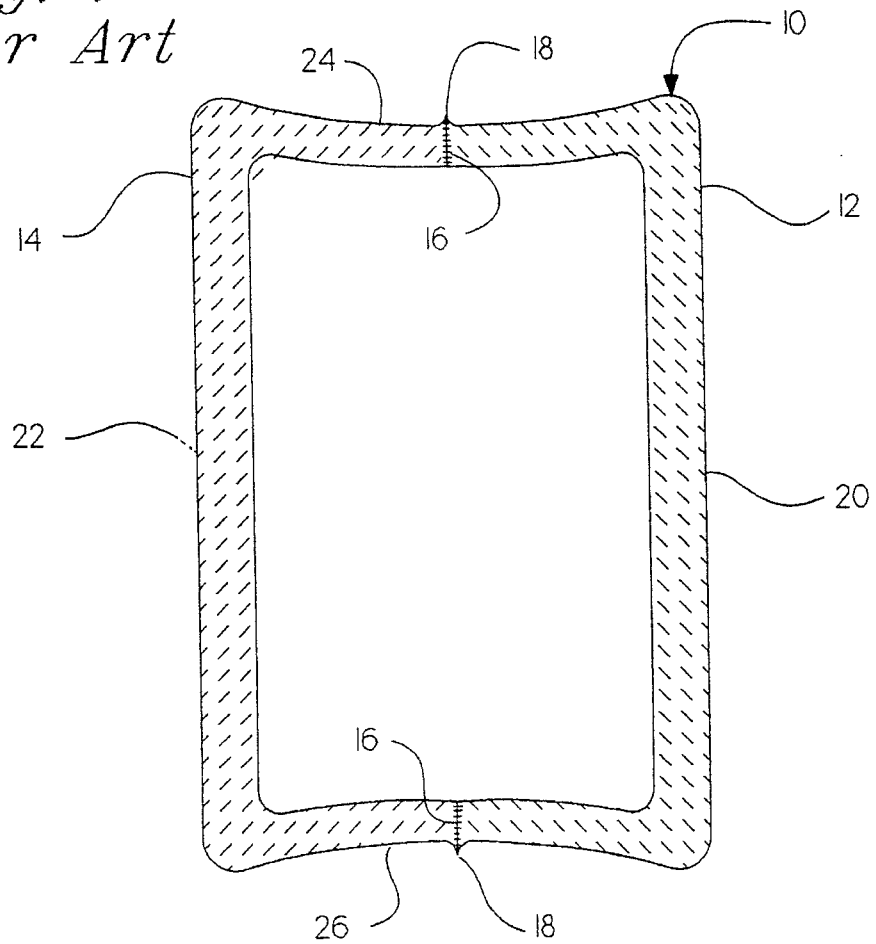
Fig.2. Prior Art
FIG. 2 is a cross-sectional view of the glass block illustrated FIG. 1.

FIG. 1 illustrates a glass block 10 of the type used in conjunction with the spacer of the present invention. FIG. 2 is a cross-sectional view of the block 10 illustrated in FIG. 1. The glass block 10 is comprised of a first half 12 and second half 14 which are mirror images of one another. The block halves 12 and 14 are fused together forming a joint or seam 16. The fusion process causes a ridge 18 to be formed in the area of the joint 16. As seen in FIGS. 1 and 2, the ridge 18 runs along the entire perimeter of the glass block 10 and is centrally located between a front face 20 and a back face 22.

The glass blocks 10 are generally rectangularly-shaped and, in addition to the front and back faces 20 and 22, respectively, include a top horizontal edge 24, a bottom horizontal edge 26, a left side edge 28, and a right side edge 30. The glass block 10 has a width W, which is the dimension from the left side edge 28 to the right side edge 30. The glass block 10 has a height H, which is the dimension from the top edge 24 to the bottom edge 26. Finally, the glass block 10 has a thickness T which is the dimension from the front face 20 to the back face 22. The ridge 18 is located at substantially one-half T.

Glass blocks of virtually any size and thickness may be used in conjunction with the spacer of the present invention to construct a mortarless glass block panel. Typical dimensions (W * H * T) of glass blocks are as follows:

| American Regular Sizes - Nominal (in inches) |
|---|
| 4 × 8 × 4 |
| 6 × 6 × 4 |
| 8 × 8 × 4 |
| 12 × 12 × 4 |
| Metric Sizes - Actual (in mm) |
| 190 × 190 × 80 |
| 240 × 240 × 80 |
| 240 × 115 × 80 |
| 115 × 115 × 80 |
| 300 × 300 × 100 |
| TRIMLINE BLOCKS - Nominal (in inches) |
| 4 × 8 × 3 |
| 6 × 6 × 3 |
| 6 × 8 × 3 |
| 8 × 8 × 3 |

As discussed more fully below, the glass blocks identified above may be used in any number or combination to produce glass block panels of various sizes and configurations.

Figure 3:
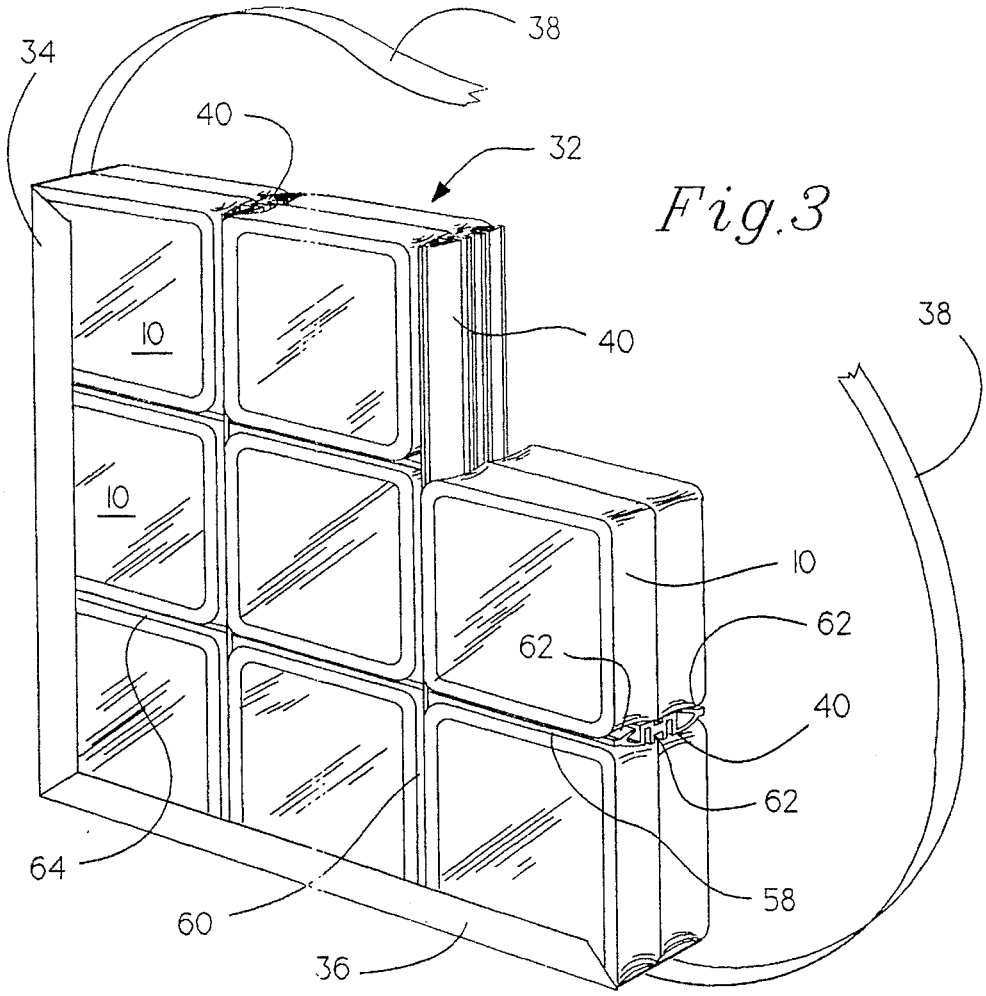
FIG. 3 is a perspective view of a partially assembled panel of glass blocks using the mortarless spacer of the present invention.

FIG. 3 is a perspective view of a partially assembled panel 32 of glass blocks 10 constructed using the mortarless spacer of the present invention. The glass block panel 32 is assembled in a temporary construction channel which consists of only a left jamb channel 34 and a sill channel 36. The construction channel, which is as wide as the thickness of the glass blocks it is to receive, has notches (not shown) every six or eight inches (15.24 or 20.32 cm) to permit sealant to be applied to the otherwise hidden ends of the horizontal and vertical joints of the glass blocks placed in the construction channel as further set forth below. A strap 38, which may be a one-half inch (12.7 mm) galvanized steel or polyester strap, is placed temporarily in the left jamb channel 34 and sill channel 36. The strap 38 must be long enough so that after the glass block panel 32 is assembled, the strap 38 will extend around the perimeter of the finished panel and be closed by a strap-seal, for example, in the center of the top of the panel.

Figure 4:
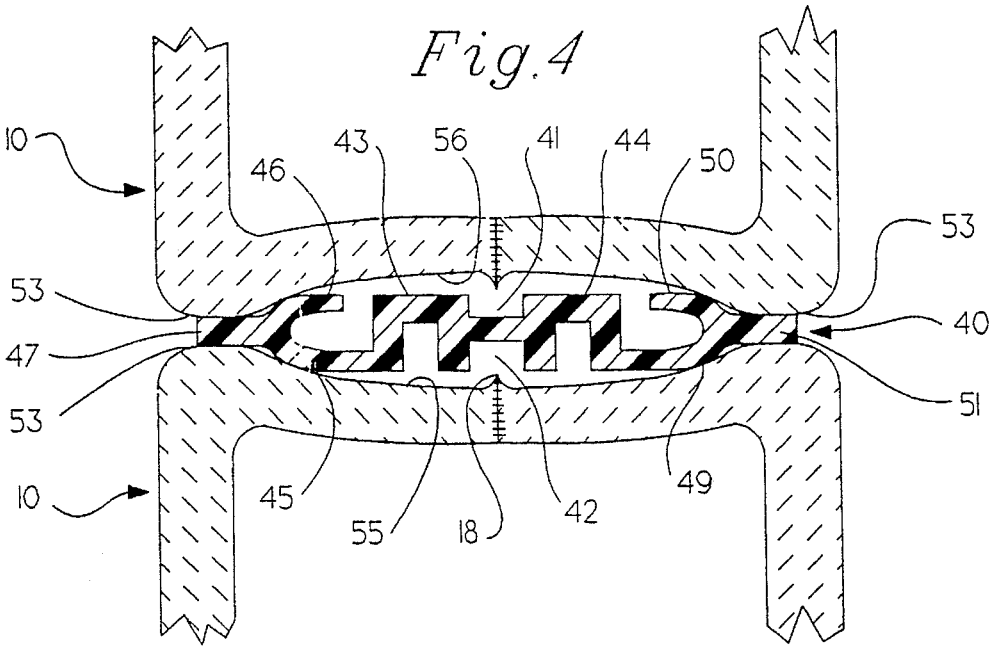
FIG. 4 is a cross sectional view of the spacer of the present invention.

The panel 32 illustrated in FIG. 3 is constructed using a spacer 40, illustrated in cross-section in FIG. 4, which is constructed according to the teachings of the present invention. The spacer 40 is comprised of first 41 and second 42 oppositely positioned channel portions adapted to receive the seams 18 of adjacent glass blocks. The channel portions 41 and 42 define a first end 43 and a second end 44 of the spacer 40. First 45 and second 46 oppositely positioned curved portions extend from the first end 43. A first pad 47 extends from a junction between the first 45 and the second 46 oppositely positioned curved portions. Third 49 and fourth 50 oppositely positioned curved portions extend from the second end 44. A second pad 51 extends from a junction between the third 49 and the fourth 50 oppositely positioned curved portions. The first 45, second 46, third 49, and fourth 50 curved portions are each configured to form a friction fit with adjacent glass blocks and are sized so that the lips 53 of the adjacent blocks contact said first 47 and second 51 pads.

The spacer 40 may be of a unitary construction and is preferably made of rigid PVC by an extrusion process. Because of the need to create a friction fit at several contact points between the spacer 40 and the adjacent glass blocks while ensuring a uniform spacing between adjacent glass blocks and ensuring that the spacer be self-centering, the dimensions of the spacer are very important.

With glass blocks 10 having a thickness T of, for example, three and one-eighth inches (80 mm), the spacer 40 has a width of approximately 2.638 inches (67 mm). The first pad 47 and second pad 51 each extend 0.16 inches (4 mm) or 0.28 inches (7 mm), outwardly from the junction with the curved portions, so as to rest on approximately one-half of the lip of the glass block, and are one-eight inch (3.175 mm) thick as is the thickness of the PVC forming the spacer itself. The PVC need not be of uniform thickness throughout the spacer. The widest distance from a first face 55 to a second face 56 is approximately 0.315 inches (8 mm).

The variable distance between faces 55 and 56, coupled with the thickness of the pads 47 and 51, results in the formation of a grid-like pattern of horizontal 58 and vertical 60 grooves (seen best in FIG. 3) between adjacent glass blocks. The horizontal 58 and vertical 60 grooves are just under one-quarter inch (6 mm) deep, by virtue of the relationship between the thickness T of the glass blocks 10, ending in curved lips, and the width of spacer 40, and have a minimum width of approximately one-eighth inch (3.175 mm), by virtue of the dimension of the pads 47 and 51 of spacer 40. The horizontal grooves 58 and vertical grooves 60 are then sealed with a sealant 62 which may be, for example, a silicone sealant. The sealant may also be placed on the opposite curved portions of the spacer 45, 46 and 49, 50 or even in the channels 41 and 42 to improve the adhesion between the spacer 40 and adjacent blocks thereby adding to the structural strength of the glass block panel.

Construction of a glass block panel 32 of the type illustrated in FIG. 3 will now be described. Although the construction will be described in conjunction with a glass block panel constructed of vertical rows, the panel could similarly be constructed of horizontal courses. The first step is to connect the left jamb channel 34 and sill channel 36 to form a ninety degree angle and to provide notches corresponding to where horizontal grooves 58 and vertical grooves 60 intersect the construction channel so that sealant can be applied to the panel even in those areas. Thereafter, the strap 38 is positioned within jamb channel 34 and sill channel 36. The first block, in this example, the block in the lower left hand corner, is firmly positioned against both the jamb channel 34 and sill channel 36. Assuming the block has a width of seven and three-quarters inches (197 mm), the spacer 40 is cut to a seven and nine sixteenths inch (192 mm) length and after silicone is applied to its curved portions, if desired, is positioned at point 64 in FIG. 3. The next block 10 in the column is positioned firmly on top of spacer 40 located at position 64 and firmly against the jamb channel 34. The process is then repeated until the entire first column or row is complete.

After the first column of blocks is completed, a spacer 40 with silicone applied to its curved portions, if desired, is vertically positioned with one face against the exposed edges of all the glass blocks in the first column. Thus, that spacer 40 has a length which is substantially equal to the height of the glass block panel 32. Thereafter, a second column or row of glass blocks is assembled in the same manner of assembly as the first column of glass blocks except that the short pieces of spacer are slightly shorter than seven and nine-sixteenths inch to allow for the cambers of the spacers on the opposite ends of the short pieces. Successive columns are built side by side until the glass block panel 32 of the desired size is assembled.

The method just described may be modified in several ways. For example, the channels 41, 42 of the spacer 40 may be filled with sealant just prior to the positioning of the spacer in the panel. Additionally, courses may be constructed horizontally if all the glass blocks in a course are of the same height. The preferred position for spacer 40, vertically or horizontally, depends on the shape of the panel. Panels which are taller than wide are preferably reinforced vertically by placing the spacer 40 vertically between columns of glass blocks and positioning small pieces of spacer 40 horizontally. Panels which are wider than tall are preferably reinforced horizontally by placing the spacer 40 horizontally between rows of glass blocks with small pieces of spacer 40 positioned vertically.

Figure 6A:
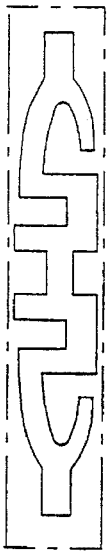
FIGS. 6A and 6B illustrate spacers having an overall rectangular profile and an overall trapezoidal profile, respectively.
Figure 6B:
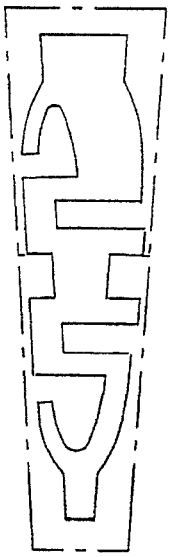

Another modification contemplates modifying the rectangular configuration of the spacer, see FIG. 6A, to a trapezoid, see FIG. 6B. The trapezoidal spacer may be interposed in vertically extending lengths between the abutting vertical edges of glass blocks used to form curved panels, for interior applications. To construct curved panels, the sill of the assembly channel is curved and the strapping is eliminated.

Figure 5:
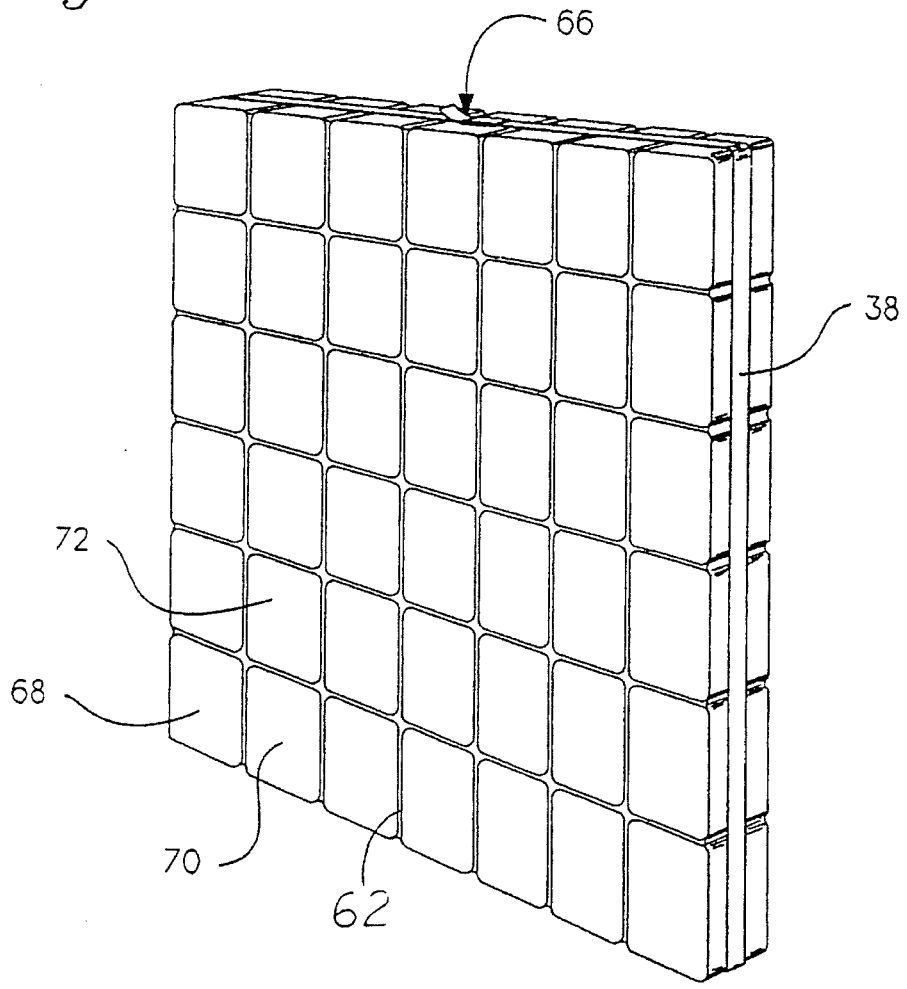
FIG. 5 is a perspective view of an assembled panel of glass blocks using mortarless spacer of the present invention.

Turning to FIG. 5, a complete glass block panel 66 is illustrated. As is seen, the glass block panel 66 has the strap 38 positioned around its perimeter and sealed in the center of the top of the panel 66. Looking at adjacent glass blocks 68 and 70, it is apparent that such horizontally adjacent blocks have abutting vertical edges. That is, the right side edge 30 of the block 68 abuts the left side edge 28 of the block 70. Similarly, vertically adjacent glass blocks 70 and 72 have horizontally abutting edges. That is, the top edge 24 of the glass block 70 abuts the bottom edge 26 of the glass block 72.

A glass block panel 66 constructed according to the teachings of the present invention and using a spacer 40 as disclosed herein provides several advantages over the prior art. First, panels can be assembled standing up since there is no concern over the weight of the glass blocks altering the spacing between lower courses of blocks. Second, the joint thickness of the present invention is automatically set to the thickness of the pads 47 and 51. Third, because there is no need for mortar to dry, panels can be assembled more quickly. Additionally, because of the configuration of the spacer 40, the spacer 40 is essentially self-centering. Thus, glass block panels may be assembled using less skilled workers. The spacer 40 reinforces the panel and provides desired rigidity without adding undue weight to the glass block panel 66 with the convex opposite curved portions of the spacer 45, 46 and 49, 50 fitting tightly into the concave shape of the glass block side walls near the lips of the glass blocks causing the glass block panel to become a monolithic whole especially when silicone is applied to these tightly fitting areas, thereby significantly increasing protection against damage from windstorms even of powerful hurricane force.

While the present invention has been described in conjunction with a preferred embodiment, those of ordinary skill in the art will recognize that many changes and modifications can be made to the preferred embodiment described herein including the piece-by-piece installation of glass blocks, using the spacer as described to construct internal partitions or exterior walls at the job site, dispensing with the strap 38 and the left jamb channel 34 and the sill channel 36. All such changes and modifications are intended to be covered by the foregoing description and the following claims.

What is claimed is:

1. A spacer for use in conjunction with glass blocks of the type which have lips around the peripheral edges thereof and a seam positioned intermediate the top, bottom, and side edges, said spacer comprising:

first and second oppositely positioned channel portions defining a first end and a second end, said channel portions sharing a common wall;

first and second oppositely positioned curved portions extending horizontally from said first end of said channel portions, said curved portions forming a U-shaped configuration opening toward said channel portions;

a first pad extending outwardly from a junction between said first and second oppositely positioned curved portions, said first pad forming a first edge of the spacer;

third and fourth oppositely positioned curved portions extending horizontally from said second end of said channel portions, said curved portions forming a U-shaped configuration opening toward said channel portions; and a second pad extending outwardly from a junction between said third and fourth oppositely positioned curved portions, said second pad forming a second edge of the spacer.

2. The spacer of claim 1 wherein said spacer is of unitary construction.

3. The spacer of claim 2 wherein said spacer is extruded rigid plastic.

4. The spacer of claim 1 wherein said spacer has an overall rectangular profile.

5. The spacer of claim 1 wherein said spacer has an overall trapezoidal profile.

6. A panel of glass blocks, comprising:

a plurality of generally rectangularly-shaped glass blocks having horizontal and vertical edges having lips therealong, each edge having a central seam running therealong, said glass blocks being arranged to form a glass block panel in which horizontally adjacent blocks have abutting vertical edges and vertically adjacent blocks have abutting horizontal edges;

a strap extending around the perimeter of said glass block panel;

a plurality of horizontally extending spacers interposed between said abutting horizontal edges and a plurality of vertically extending spacers interposed between said abutting vertical edges to provide a uniform spacing between said adjacent glass blocks, each of said spacers having:

first and second oppositely positioned channel portions defining a first end and a second end, said channel portions sharing a common wall, first and second oppositely positioned curved portions extending horizontally from said first end of said channel portions and forming a U-shaped configuration opening towards said channel portions which is configured to form a friction fit with adjacent glass blocks, a first pad extending from a junction between said first and second oppositely positioned curved portions, third and fourth oppositely positioned curved portions extending horizontally from said second end of said channel portions and forming a U-shaped configuration opening towards said channel portions which is configured to form a friction fit with adjacent glass blocks, a second pad extending from a junction between said third and fourth oppositely positioned curved portions, and wherein the width of said spacer is less than the width of said glass blocks such that the lips of the adjacent blocks contact said first and second pads to form a groove between adjacent glass blocks; and a sealant positioned in said groove.

7. The glass block panel of claim 6 additionally comprising sealant on said first, second, third, and fourth curved portions.

8. The glass block panel of claim 7 wherein said sealant is a silicone sealant.

9. The glass block panel of claim 6 additionally comprising sealant in said channel portions.

10. The glass block panel of claim 6 wherein said horizontally adjacent glass blocks are of uniform height, and said horizontally extending spacers have a length substantially equal to the width of said glass block panel and said vertical spacers have a length slightly less than the height of said glass blocks.

11. The glass block panel of claim 6 wherein said vertically adjacent glass blocks are of uniform width, and said vertically extending spacers have a length equal to the height of said glass block panel and said horizontal spacers have a length slightly less than the width of said glass blocks.

12. The glass block panel of claim 6 wherein said strap is a galvanized steel strap.

13. The glass block panel of claim 6 wherein said strap is a polyester strap.

* * * * *

UNITED STATES PATENT AND TRADEMARK OFFICE

CERTIFICATE OF CORRECTION

PATENT NO. : 5,485,702
DATED : January 23, 1996
INVENTOR(S) : Bernard C. Sholton It is certified that error appears in the above-indentified patent and that said Letters Patent is hereby corrected as shown below:

Col. 4, line 4, after "illustrated" insert --in--.

Signed and Sealed this

Sixteenth Day of July, 1996

Bruce Lehman

*Attest:*

BRUCE LEHMAN

*Attesting Officer*

*Commissioner of Patents and Trademarks*